United States Patent [19]

Pavlik

[11] 4,296,945

[45] Oct. 27, 1981

[54] POCKET SECRETARY OR THE LIKE

[76] Inventor: Kathleen W. Pavlik, R.D. #1, Box 328A, Rehoboth, Del. 19971

[21] Appl. No.: 100,596

[22] Filed: Dec. 5, 1979

Related U.S. Application Data

[63] Continuation of Ser. No. 874,609, Feb. 2, 1978, abandoned.

[51] Int. Cl.[3] ..... B42D 3/00; A45C 1/08

[52] U.S. Cl. ..... 281/1; 281/31; 150/35

[58] Field of Search ..... 281/30, 31, 16, 17, 281/1; 150/52 B, 35; 190/41 Z, 42; 283/63 R, 55, 66 A, 66 R; 282/9 R, 8 A

[56] References Cited

U.S. PATENT DOCUMENTS

| | | | |
|---|---|---|---|
| 959,282 | 5/1910 | Wilson | 402/63 |
| 989,968 | 4/1911 | Heil | 281/16 |
| 991,753 | 5/1911 | Schober | 281/50 |
| 1,577,697 | 3/1926 | Douglas | 281/33 |
| 1,683,238 | 9/1928 | Cardoza | 281/47 |
| 1,735,211 | 11/1929 | Parr | 281/50 |
| 2,194,023 | 3/1940 | Kranhold | 40/119 |
| 2,215,163 | 9/1940 | Shedd | 281/15 |
| 2,228,457 | 1/1941 | Hoople | 281/1 |
| 2,354,782 | 8/1944 | Stradling | 281/16 |
| 2,828,975 | 4/1958 | Wright | 281/31 X |
| 2,833,565 | 5/1958 | Santino | 281/17 |
| 2,894,767 | 7/1959 | Friedman | 281/15 |
| 2,953,397 | 9/1960 | Diamond | 281/15 |
| 3,201,146 | 8/1965 | Tilton | 281/31 |
| 3,208,772 | 9/1965 | Dahlstrand | 283/63 |
| 3,267,940 | 8/1966 | La Fleur | 281/16 X |
| 3,520,560 | 7/1970 | Isaac | 283/56 |
| 3,594,935 | 7/1971 | Blattstein | 281/15 X |
| 3,620,552 | 11/1971 | Woodcock | 281/16 X |

FOREIGN PATENT DOCUMENTS

| | | | |
|---|---|---|---|
| 1348492 | 12/1963 | France | 281/15 R |
| 2367621 | 6/1978 | France | 281/31 |

*Primary Examiner*—Paul A. Bell
*Assistant Examiner*—John S. Brown
*Attorney, Agent, or Firm*—Steele, Gould & Fried

[57] ABSTRACT

A pocket secretary or the like, comprising a foldable member, three pocket means secured to the foldable member, means for detachably mounting a notebook secured to the foldable member, an envelope means secured to the foldable member, and, releasable closure means for retaining the foldable member in a folded condition, such that two of the pocket means are disposed opposite one another and the other of the pocket means is disposed opposite the detachable mounting means.

8 Claims, 4 Drawing Figures

POCKET SECRETARY OR THE LIKE

This is a continuation of application Ser. No. 874,609, filed Feb. 2, 1978, and now abandoned.

BACKGROUND OF THE INVENTION

I. Field of the Invention

The present invention relates in general to devices used for organizing many of the objects carried in one's pocket, one's pocketbook or kept in a drawer or on a desk top. In particular, the present invention relates to the field of pocket secretaries. More specifically, the present invention relates to pocket secretaries which complement the use of a handbag or pocketbook, by organizing many of the articles carried therein. Not only does such a pocket secretary provide organization and easy access to organized materials, but such convenience is enhanced since the subject invention may be easily carried in most handbags or pocketbooks.

The present invention also relates to the field of notebook securement means, and in particular, to detachable mounting means for spiral-bound type notebooks or the like.

II. Description of the Prior Art

Various kinds of pocket secretaries or the like are known in the prior art, each of which discloses no more than a few of the features found in the pocket secretary according to the present invention. These known features include releasable flap securing means, the use of pouches or pockets, means for listing telephone numbers and mounting notebooks, an envelope for receipts and cylindrical pen or pencil mounting means.

As relates to detachable notebook securement means, the prior art discloses means for securing loose leaf pages and magazines, but not spiral-bound notebooks or the like. The only reference which discloses securement means which might be usable with a spiral-bound notebook is much too large for use in a pocket secretary, and there is no obvious means for adapting it for such use.

None of the references related to notebook securement means teaches means suitable for detachably mounting a spiral-bound notebook or the like in a pocket secretary, and none of the references related to pocket secretaries suggest the use of means for permanently but detachably mounting a first notebook, and having further means for holding a removable notebook. No combination of the references found in the prior art combines as many features as are included in the present invention. In fact, the present invention comprises a permanently but detachably mounted notebook, a removable notebook, a transparent coupon envelope, a telephone number listing, pencil holding means and releasable closure means, all in a fairly compact structure wherein each of the elements is easily accessible, wherein use of no element interferes with the use of another element and wherein each element is safely and securely contained.

SUMMARY OF THE INVENTION

It is an object of the present invention to provide a means for conveniently filing, storing and carrying a wide variety of information and documents.

It is a further object of the present invention to provide a means for conveniently filing, storing and carrying a wide variety of information and documents, which means includes a permanently attachable notebook and a removable notebook.

It is a still further object of the present invention to provide a means for conveniently filing, storing and carrying a wide variety of information and documents, which means includes a transparent envelope means for holding and displaying coupons.

It is another object of the present invention to provide a means for conveniently filing, storing and carrying a wide variety of information and documents, which means includes carrying means for writing implements, such as pens or pencils.

It is yet another object of the present invention to provide a means for conveniently filing, storing and carrying a wide variety of information and documents, which means includes detachable mounting means for a spiral bound type notebook or the like.

Briefly, a pocket secretary or the like according to the present invention comprises a foldable member, three pocket means secured to the foldable member, means for detachably mounting a notebook secured to the foldable member, an envelope means secured to the foldable member, and, releasable closure means for retaining the foldable member in the folded condition, such that two of the pocket means are disposed opposite one another and the other of the pocket means is disposed opposite the notebook mounting means. The mounting means and the pocket means disposed opposite thereto are mounted on parts of the foldable member forming the narrow ends thereof when the pocket secretary is folded. The detachable mounting means, which is particularly adapted for use with spiral bound type notebooks or the like, comprises a square, U-shaped member having a relatively long base and relatively short sides, rod means disposed between the sides, and, means for detachably securing the rod means to the sides. In the presently preferred embodiment, the sides of the bracket have aligned holes, through which the rod means is mounted. To particular advantage, the envelope means is transparent, to facilitate the display of coupons, and has releasable closure means.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENT

Figure 1:
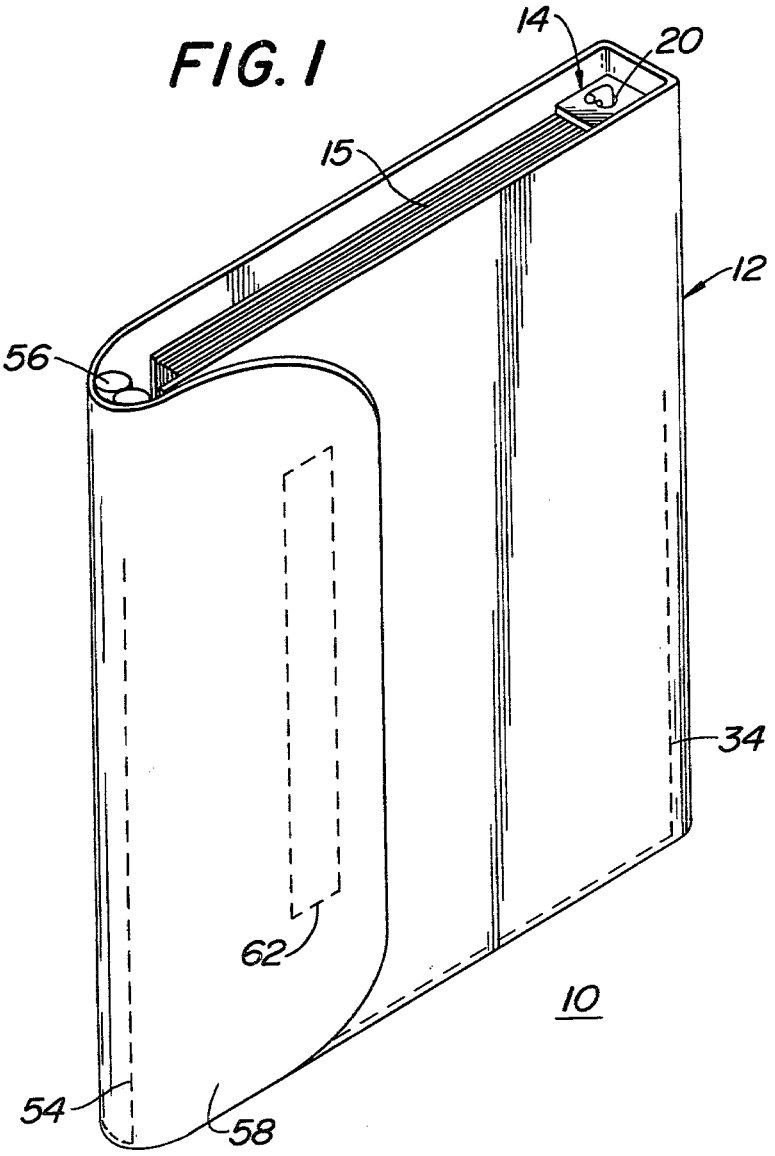
FIG. 1 is a perspective view of a pocket secretary according to the present invention in a folded state.
Figures 2, 3:
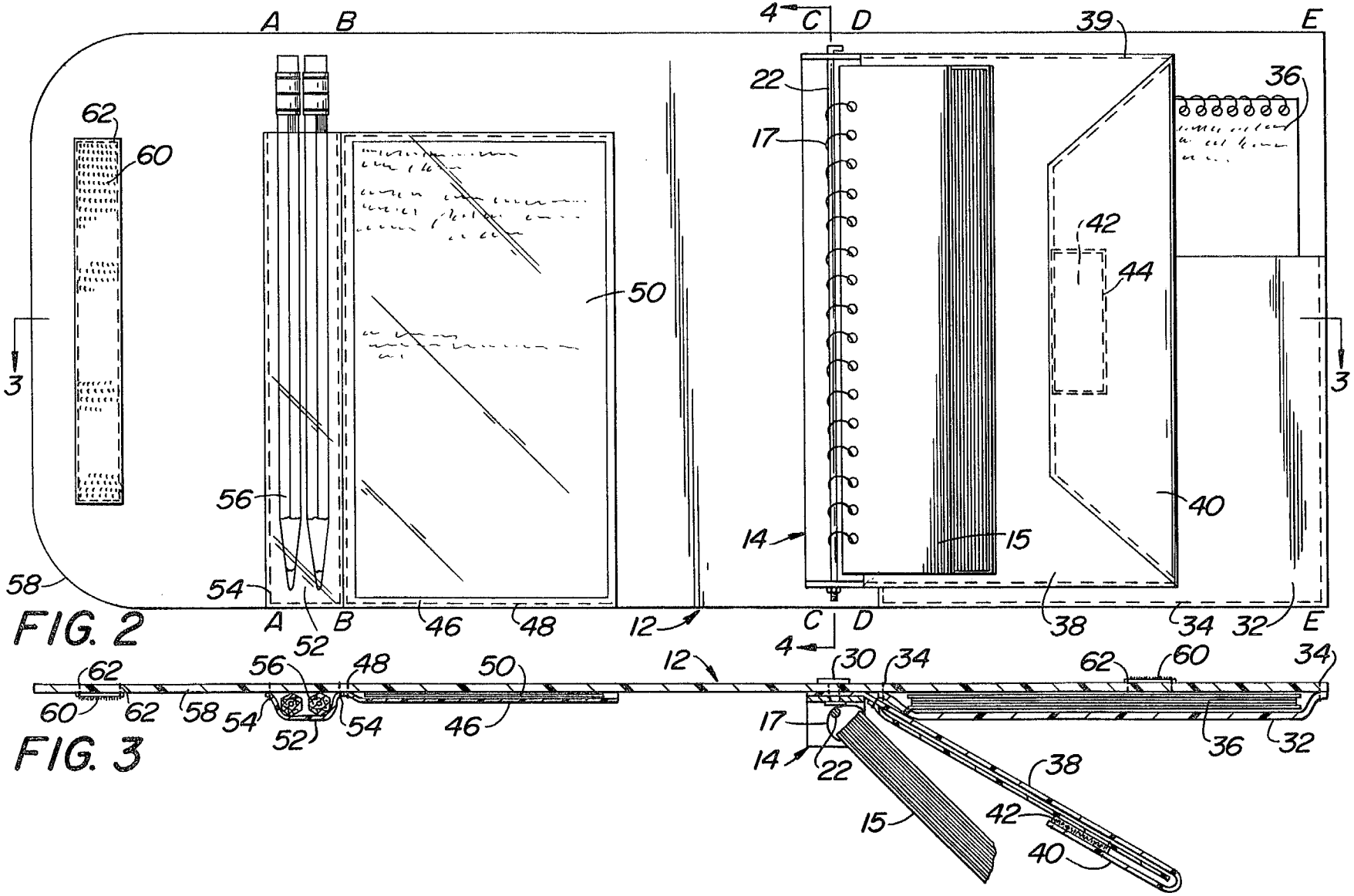
FIG. 2 is a front view of a pocket secretary according to the present invention, laid completely open.
FIG. 3 is a section view taken along the line 3—3 of FIG. 2.

With reference to FIGS. 1 and 2, wherein like numerals indicate like elements, a pocket secretary 10 according to the present invention has a foldable body member generally designated 12, to which all of the remaining elements of the pocket secretary 10 are attached. The foldable body member 12 may be leather, plastic or vinyl, or any other material which is soft, flexible, foldable and somewhat resistant to tearing due to repeated folding. It might also be desirable to utilize material which is internally stiffened by sections of cardboard or the like.

For purposes of clarification, certain points on the foldable member 12 have been referenced by letters A-E. These letters define folding lines for the body member 12 as well as component sections of the body member 12. With reference to FIG. 2, the pocket secretary 10 is intended to be folded along the lines which would connect letters A-A, B-B, C-C and D-D. When the invention is folded, edge E-E of the foldable body member 12 will rest inside of fold A-A. It may be seen, then, that when so folded, sections A-B and C-D form oppositely disposed, narrow ends. Similarly, sections B-C and D-E form oppositely disposed longer sides.

Figure 4:
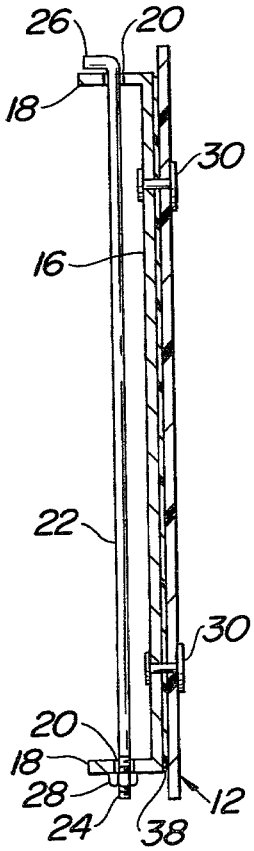
FIG. 4 is a section view taken along the line 4—4 of FIG. 2.

Means for permanently but detachably mounting a spiral bound type notebook or the like, generally designated by numeral 14, is attached to the foldable body member 12 in section C-D. In the presently preferred embodiment, as shown more particularly in FIG. 4, the detachable mounting means 14 comprises a square, U-shaped bracket having an elongated base 16 and two short vertical sides 18. The sides 18 have aligned holes 20 therein, through which rod 22 may be fitted. Rod 22 has a threaded end 24 and a bent head section 26, which prevents the rod 22 from slipping through either of the holes 20. The rod 22 is secured to the square, U-shaped bracket by nut means 28. The U-shaped bracket is itself fastened to foldable body member 12 by rivet means 30. In use, a spiral bound type notebook or the like 15 or appropriate size is placed with its spiral element 17 between the two sides 18 of the U-shaped bracket, as shown more particularly in FIGS. 2 and 3. Rod 22 is then slipped through one of the holes 20, through the center of the spiral element 17, and then through the other of the holes 20. The rod, with the notebook 15 secured thereto, is then fastened in place by nut means 28. In FIG. 2, notebook 15 is depicted as extending out of the Figure, in order to reveal other elements in section D-E of the present invention. In FIG. 3, notebook 15 appears smaller than normal because its end is partially cut away.

With reference to FIGS. 2 and 3, a first pocket means 32 is secured to section D-E of the foldable body member 12 by first pocket securement means 34, in the presently preferred embodiment, stitching. First pocket means 32 opens at the top thereof, to provide a convenient means for holding a removable notebook or note pad 36. An envelope 38 is also disposed in section D-E, over first pocket means 32, and may be secured to the foldable body member 12 by the rivet means 30 which secure the U-shaped bracket of the detachable mounting means 14. The envelope is preferably transparent, in order to display store coupons and the like which may be stored therein. The envelope may be formed by front and back elements or layers, connected by attachment means 39, such as stitching. The closing flap 40 of the envelope 38 is provided with releasable closure means 42, secured to the body of the envelope 38 and the flap 40 by attachment means 44, preferably stitching. The releasable closure means 42 comprises two mating strips, preferably of the hook and loop type, wherein one strip has a plurality of hooks which engage a plurality of loops on the other strip, the strips being disengageable by peeling one from the other. Strips of this type are commercially available under the trademark VELCRO.

A second pocket means 46 is attached to section B-C of the foldable body member 12 by second pocket attachment means 48, preferably stitching. Second pocket means 46 may open to the side, as shown, or to the top, and is preferably transparent. The second pocket means 46 can accomodate an information sheet 50, which may contain and display such information as special telephone numbers.

A third pocket means 52 is attached to section A-B of foldable body member 12, by third pocket attachment means 54, also preferably stitching. Third pocket or holding means 52 opens at the top, and is particularly adapted for holding writing implements such as pencils 56. It may be noted that third pocket or holding means 52 does not extend the full height of foldable body member 12, in order to provide an open space for grasping the pencils or the like.

Foldable body member 12 includes a closure flap 58, the inside surface of which abuts the outside surface of section D-E when the pocket secretary 10 is folded to a closed position as shown in FIG. 1. Closure flap 58 is secured to the back of section D-E by releasable closure means 60, secured by attachment means 62, also stitching in this preferred embodiment. Releasable closure means 60 may be identical to releasable closure means 42.

When the pocket secretary 10 is secured in its folded or closed position, first pocket means 32 and second pocket means 46 are disposed opposite one another, with notebook 15 and envelope 38 interposed therebetween. Similarly, the detachable mounting means 14 and third pocket means 52 are also disposed opposite one another.

It will be apparent to those skilled in the art that various attachment means can be substituted for those utilized in the presently preferred embodiment. For example, rivet means 30 might be replaced with nuts and bolts. Stitching means 34, 44, 48, 54 and 62 might be replaced with rivets or a permanent adhesive. The various pocket means might easily be riveted at points about their peripheries or at least at their corners. The strips of the releasable closure means 42 and 58 might very easily be secured by a permanent adhesive or other suitable cement or glue. The releasable closure means themselves might very well be conveniently replaced by button or snap means.

It can be appreciated that a pocket secretary or the like according to the present invention provides a means for permanently but detachably mounting a notebook, means for removably mounting a notebook, transparent envelope means for storing and displaying coupons or the like, transparent pocket means for storing and displaying important information, pencil or pen holding means and releasable closure means. Further, a pocket secretary according to the present invention provides all of the foregoing features in a fairly compact structure wherein each of the elements is easily accessible, wherein the use of no element interferes with the use of any other element and wherein each element is safely and securely contained.

In view of the foregoing, the present invention may be embodied in other specific forms without departing from the spirit or essential attributes thereof, and accordingly, reference should be made to the appended claims, rather than to the foregoing specification as indicating the scope of the invention.

I claim:

1. A pocket secretary or the like, comprising:

a flexible foldable member with at least two folding areas;

three pocket means secured to said foldable member, one of said pocket means being narrow, for holding writing implements, and being disposed in a folding area of said foldable member;

means for detachably mounting a separately bound notebook, secured to another folding area of said foldable member;

an envelope means secured to said foldable member together with said detachable mounting means; and releasable closure means for retaining said foldable member in a folded condition, including an overlapping flap and releasable attachment means, wherein said narrow pocket means is disposed opposite said detachable mounting means when said member is folded, and said other two pocket means are disposed opposite one another, said mounting means and said writing implements, when held in said narrow pocket means, providing structural support for said flexible member, when folded.

2. The pocket secretary or the like of claim 1, wherein said detachable mounting means for said separately bound notebook comprises:

a square, U-shaped member, having a relatively long base and relatively short sides;

rod means disposed between said sides; and, means for detachably securing said rod means to said sides.

3. The pocket secretary or the like of claim 2, wherein said sides of said bracket have aligned holes, through which said rod means is mounted.

4. The pocket secretary or the like of claim 1, wherein at least part of said releasable attachment means is mounted inside of said flap and the remainder is correspondingly disposed on the outside of said foldable member opposite said flap, when said pocket secretary is folded.

5. The pocket secretary or the like of claim 1, wherein said envelope means is transparent, and has releasable closing means.

6. The pocket secretary or the like of claim 1, wherein two of said pocket means have open tops and one of said pocket means has an open side.

7. The pocket secretary or the like of claim 1, wherein said narrow pocket means and one of said oppositely disposed pocket means have open tops and the other of said pocket means has an open side.

8. The pocket secretary or the like of claim 1, wherein said separately bound notebook is spirally bound, and said mounting means includes structure insertable through said spiral binder.

* * * * *